US007012226B1

(12) United States Patent
George

(10) Patent No.: US 7,012,226 B1
(45) Date of Patent: Mar. 14, 2006

(54) CARTRIDGE HEATER WITH A RELEASE COATING

(75) Inventor: William J. George, Bartlett, IL (US)

(73) Assignee: Durex International Corporation, Cary, IL (US)

( * ) Notice: Subject to any disclaimer, the term of this patent is extended or adjusted under 35 U.S.C. 154(b) by 0 days.

(21) Appl. No.: 10/858,805

(22) Filed: Jun. 2, 2004

(51) Int. Cl.
*H05B 3/50* (2006.01)

(52) U.S. Cl. ..... 219/544; 219/523; 219/534; 219/540; 392/497

(58) Field of Classification Search ..... 219/523, 219/534, 544, 206, 540; 392/497; 330/230, 330/238, 273
See application file for complete search history.

(56) References Cited

U.S. PATENT DOCUMENTS 3,965,808 A 6/1976 Chomette
4,227,535 A 10/1980 Connor
4,841,127 A 6/1989 Prager et al.
5,013,890 A 5/1991 Gamble
5,136,143 A * 8/1992 Kutner et al. ..... 219/544
5,176,339 A * 1/1993 Schmidt ..... 244/54
2004/0112893 A1 * 6/2004 Okuda ..... 219/544

OTHER PUBLICATIONS

Fighting Friction with Bonded Coatings, Machine Design Magazine, Apr. 10, 1980.

* cited by examiner

*Primary Examiner*—Robin O. Evans
*Assistant Examiner*—Leonid M. Fastovsky
(74) *Attorney, Agent, or Firm*—Lloyd L. Zickert

(57) ABSTRACT

A cartridge heater for mounting in the bore hole of a device to heat the device, having an improved release coating to facilitate the removal of the cartridge heater from the bore hole subsequent to operation at elevated temperatures, wherein the release coating is a fast-drying, graphite-based solid film lubricant that bonds to the heater.

14 Claims, 1 Drawing Sheet

CARTRIDGE HEATER WITH A RELEASE COATING

This invention relates in general to an electrical resistance cartridge heater for mounting in the bore hole of a device to produce heat for the device and having a solid film lubricant to facilitate removal of the heater from the bore hole subsequent to operation of the heater, and more particularly to a cartridge heater having a release coating in the form of a fast-drying, graphite-based solid film lubricant that is capable of producing a low coefficient of friction on the sheath of the cartridge heater and withstanding elevated temperature conditions.

BACKGROUND OF THE INVENTION

Cartridge heaters for producing heat in devices, such as plastic molding machines, are well known. Such heaters include an electrical heating element suitably enclosed in a cylindrical or polygonal metal sheath or casing that is usually made of a suitable steel alloy. The heaters are adapted to be inserted into bore holes for producing a close fit to produce maximum heat transfer from the cartridge heater to the transfer device. Because of the dose fitting bore holes in which the heaters are inserted after multiple cycles of high temperature operations, it is common that the cartridge heater will be difficult, if at all possible, to remove from the bore hole. In effect, the cartridge heater seizes in the bore hole after operation. Thereafter, removal of the cartridge heater may cause damage to the heater as well as to the device in which it is used.

Heretofore, in order to facilitate removal of such cartridge heaters from bore holes, various lubricants have been applied to the casings or sheaths of the heaters prior to insertion into the bore holes. For example, it is known to have dipped cartridge heaters into milk of magnesia in order to facilitate removal after operation.

It has also been known to apply bonded solid lubricants, such as disclosed in U.S. Pat. No. 5,136,143. The preferred solid lubricant in this patent is molybdenum disulfide. This patent also suggests that other solid lubricants could be used, which include fluropolymers, ceramic materials, oxides, and mineral powders such as graphite. The patent describes the solid lubricant to require a temperature of greater than 400° F. during use before the lubricant is fully cured and describes the lubricant to have degraded into a flaky or powdery form that separates from the sheath when the heater is removed from the bore hole after use.

Other types of coatings have been suggested for operating electrical resistance heating elements in other environments.

The problem of prior art coatings for cartridge heaters is that the coatings must be cured at a very high temperature and that the coating can degrade and flake off upon removal of the heater from a device.

SUMMARY OF THE INVENTION

The present invention provides a release coating for a cartridge heater that overcomes the problems of prior known release coatings on cartridge heaters by facilitating the curing of the coating prior to insertion of the heater into a bore hole. Further, the release coating of the present invention is maintained substantially intact upon removal of the cartridge heater from a bore hole.

The cartridge heater of the present invention with the release coating therefore overcomes the problems of the prior art. The release coating of the present invention is in the form of a graphite-based solid film lubricant with an organo-metallic binder system wherein the lubricant provides a low coefficient of friction on the cartridge heater sheath and thermal stability for operating in high temperature conditions. The lubricant is in liquid form and suitably applied to the sheath of a cartridge heater by dipping or spraying procedures and the lubricant is capable of drying to touch within five minutes in an atmosphere or ambient of 60 to 100° F. and a relative humidity of at least 50 percent. Further, the coating fully cures within six hours from the time of application. Because the coating is fully cured before insertion of the heater in a bore hole, the coating cannot be dislodged during insertion.

The combination cartridge heater and coating of the present invention is fully cured when it is shipped out to a user from the factory. After use of the heater of the present invention by a user subsequent to the heater being cycled to multiple high temperatures of operation, the heater may be easily rotated in the bore hole and removed during maintenance of the device in which it is used. Upon removal, the coating remains substantially intact on the cartridge heater sheath, thereby assuring it is intact during operation in a device.

The present invention also relates to the method of preparation of the cartridge heater before application of the release coating. The preparation in general includes degreasing, grit-blasting, and removal of any residual blast media from the heater sheath substantially immediately prior to the application of the release coating. This preparation enhances the bonding of the coating to the heater sheath and assuring the coating will serve to allow easy removal from a bore hole.

It is therefore an object of the present invention to provide a new and improved cartridge heater with a release coating to facilitate removal of the cartridge heater from a bore hole after operation at elevated temperatures and which therefore prevents seizing of the cartridge heater in the bore hole.

A further object of the present invention is in the provision of a cartridge heater with a solid film lubricant that is graphite-based with an organo-metallic binder system and which is capable of drying to touch in a few minutes and curing in a few hours.

A further object of the present invention is to provide a method of preparation of the cartridge heater for the subsequent application of a release coating that is capable of drying to touch in a few minutes and curing in a few hours in an ambient of 60 to 100° F. and a relative humidity of at least 50 percent.

Other objects, features and advantages of the invention will be apparent from the following detailed disclosure, taken in conjunction with the accompanying sheets of drawings, wherein like reference numerals refer to like parts.

DESCRIPTION OF THE INVENTION

This invention relates to a cartridge heater having a release coating to facilitate removal from the bore hole of a device or apparatus after the cartridge heater has been operated at elevated temperatures. The release coating is in the form of a solid film lubricant that is graphite-based and which when applied in liquid form to the heater will dry to touch in less than five minutes and completely cure in less than about six hours in an ambient having a temperature ranging between 60 to 100° F. and a relative humidity of at least 50 percent.

The invention also relates to the method of preparing a cartridge heater for receiving the release coating which includes degreasing the sheath of the heater, grit-blasting the sheath, removal of residual blast media, and optionally passivating the sheath. Thereafter, application of the liquid lubricant may be done by dipping the heater into a bath of liquid lubricant, optionally spinning it to remove excess lubricant, spraying the lubricant onto the heater to a suitable thickness, or any other suitable process.

After the release coating is cured, the combination cartridge heater with a release coating is then ready to be shipped to a user.

Figure 1:
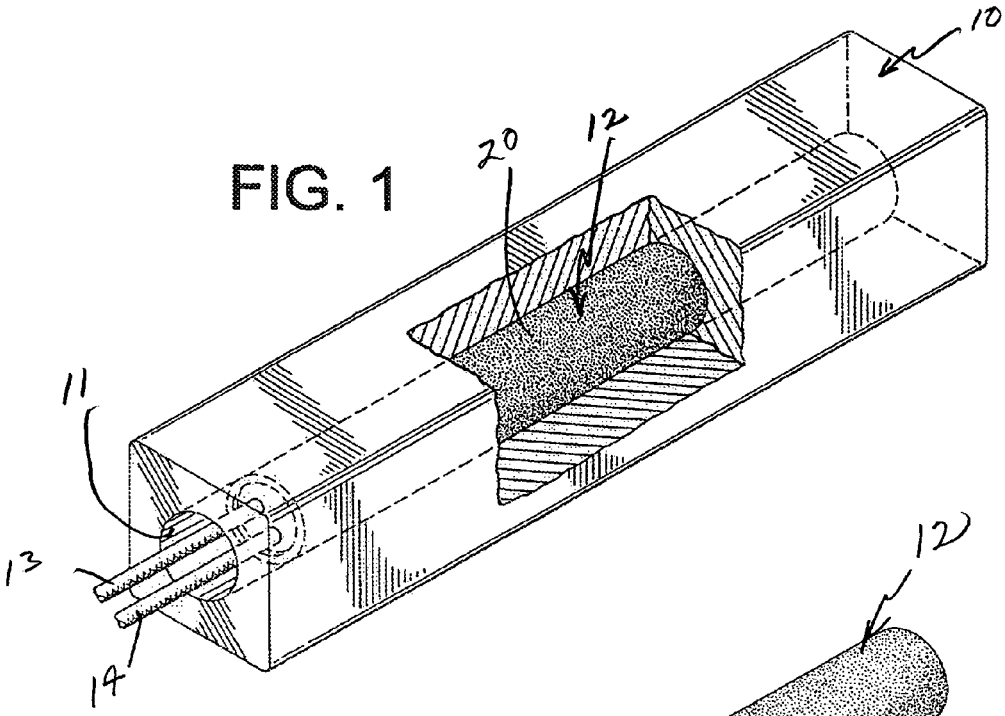
FIG. 1 is a perspective view of a block used in a device for transferring heat to the device and having a bore hole in which is inserted a cartridge heater with the coating of the present invention and which is partially broken away to show a portion of the heater with its coating.
Figure 2:
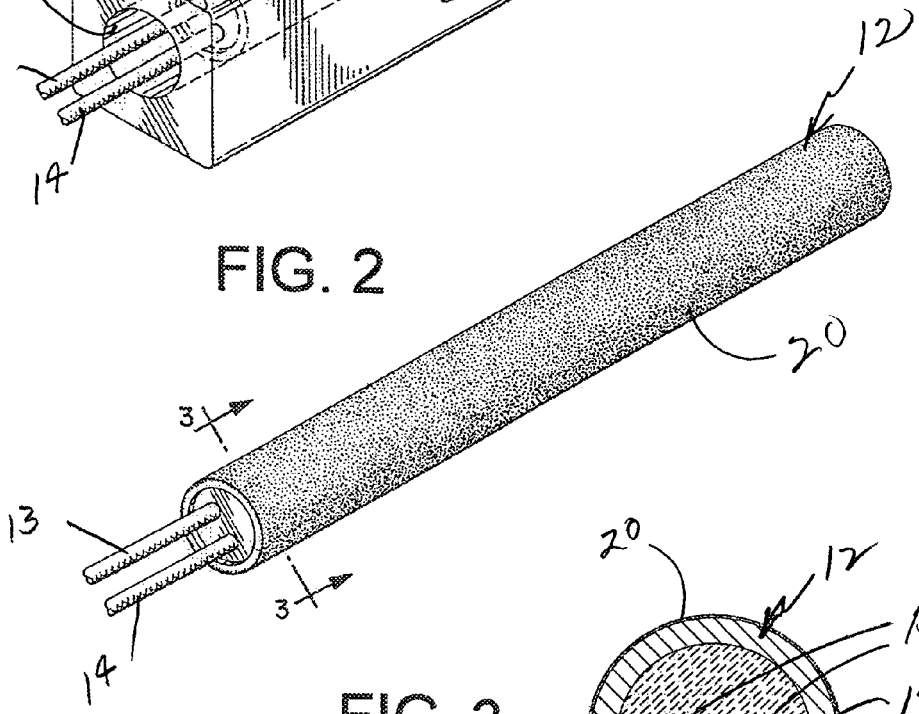
FIG. 2 is a perspective view of a cartridge heater with a release coating of the present invention and which is removed from a bore hole of a device.
Figure 3:
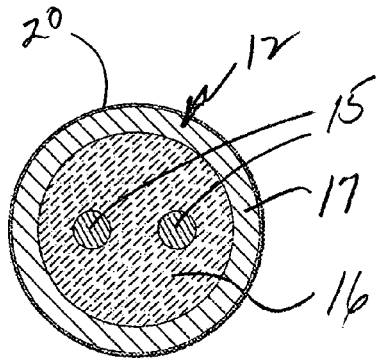
FIG. 3 is a transverse sectional view of the cartridge heater of FIG. 2 taken substantially along line 3—3.

Referring now to the drawings, a heating block 10 is shown in FIG. 1 with a bore hole 11. A cartridge heater 12 is shown in mounted position in the bore hole 11. It will be appreciated that the cartridge heater is of a type having any suitable resistance wire arranged in suitable insulation and having electrical leads 13 and 14 for electrical connection to a source of power. In the cross-sectional view of FIG. 3, the heater 12 is shown to include resistance wires 15 embedded in a suitable insulating material 16 which is contained in a metal sheath 17. It will be appreciated that usually the cartridge heater will be cylindrically shaped, but it could be polygonaly shaped in cross section if desired. A release coating 20 is shown on the sheath 17 of a material described below.

The release coating is a fast-drying, graphite-based solid film lubricant called Perma-Slik RGAC available from the Everlube Products Division of Morgan Advanced Ceramics in Peachtree City, Ga. This lubricant is a graphite-based solid film lubricant with an organo-metallic binder system and provides an extremely low coefficient of friction and excellent thermal stability and is capable of withstanding temperatures up to at least 1200° F. The lubricant is in a solvent-based carrier and may be applied by a dip/spin or spray procedure. When the coating is applied and dried, it will have a thickness of about 0.2 to 0.6 mils (5–15 microns). The coating includes a graphite in a binder that is organo-metallic and is diluted in a suitable solvent such as heptane or toluene at a ratio of 1:1 to 2:1.

In order for the coating material to properly bond to the sheath surface of a heater, the sheath surface must be properly prepared that will result in the appropriate adhesion and base wear life.

The first step of a proper pretreatment is to degrease the surface of the sheath with an appropriate solvent by vapor or aqueous degreasing. The degreasing will remove any oil, dirt or other foreign matter from the sheath. It will be appreciated that the sheath metal may be a steel alloy such as a non-magnetic stainless steel, a titanium alloy, or any other suitable metal alloy that can properly withstand the forces subjected to the heater and also the elevated temperatures under which the heater will operate.

After degreasing the metal substrate, it is next subjected to grit-blasting to remove scale, rust and other foreign matter and to slightly roughen the surface. While any suitable type of grit-blasting material may be used, 220 mesh aluminum oxide at 50 pounds pressure will suffice to provide a surface finish of 25 to 35 micro inches. The grit-blasting should be performed in such a manner as to achieve the desired finish with a minimal dimension change.

Thereafter, the heater sheath's substrate should be thoroughly cleaned to remove any residual blast media. This may be accomplished by first subjecting the parts to compressed air and then recleaning with a suitable degreasing process.

Subsequent to grit-blasting and degreasing, a stainless steel sheath should be passivated. After degreasing and grit-blasting, steel parts may be coated with the lubricant.

Titanium, nickel and cobalt sheaths should be coated after grit-blasting and degreasing. Non-halogenated solvents should be used with such parts. It will also be appreciated that nickel and chrome blasted surfaces may be coated after a light grit-blast and degreasing.

Following the preparation of the sheath surface, the liquid lubricant may be applied by spray, dip or dip/spin processes.

Following the application of the above coating, the cartridge heater with the coating is subjected to an ambient moisture cure coating system. While cure time is dependent on ambient temperature and relative humidity with a temperature between 60 to 100° F. and a relative humidity of at least 50 percent, the coating will dry to the touch in a few minutes and usually less than five minutes and fully cure within six hours.

Accordingly, the coating will provide a solid film lubricant on the cartridge heater to prevent seizing in a heating block. Examples of tests conducted with one heater having the coating applied and one heater with no coating applied, where the heater is ½ inch in diameter and 8 inches long and rated at 1000 watts and operable at 240 volts in a test block that is 8¾ inches long by 2½ inches wide and 1½ inches deep of 1018 steel and having two bore holes of about 0.505 inch in diameter and spaced one inch apart. The test procedure included applying a coating to one of the heaters and having no coating applied to the other heater as follows:

EXAMPLE 1

The two heaters, one with the coating and one without, were mounted in the test block. The block was set at an ambient temperature and voltage applied to the block to be heated to 725° F. A thermocouple was centered on the length of the block as well as being centered on the width of the block. The block was cycled ten times at 725° F. temperature and then brought down to 180° F. The heater with the coating was rotatable while the heater without the coating was not rotatable.

EXAMPLE 2

Again, with one heater with the coating applied to it and one with no coating applied to it and mounted in the test block Voltage was applied to the heaters at 180° F. and was brought up to 725° F. This test also included a thermocouple as in the first example. Like Example 1, the heaters were cycled ten times at 725° F. temperature. Then the rotation test was again used and the results were the same where the coated heater rotated easily and the non-coated heater would not rotate.

EXAMPLE 3

This test did not include the use of any thermocouple to control the temperature. Again, one heater with a coating applied to it and one heater with no coating applied to it were inserted in the test block bore holes. The temperature was allowed to run wild and the block reached a temperature of 1600° F. within the first hour that power was applied to the heaters. The heaters ran for about six hours at that temperature and the block did not exceed the 1600° F. temperature. After a period of six hours the test block was allowed to cool down to ambient temperature and the rotation test was again made. Again, the coated heater was rotatable, while the uncoated heater was not rotatable. Further, the coated heater was removable with little difficulty, but the non-coated heater was not removable.

In view of the foregoing, it should be appreciated that the present invention provides a heater with a sold film lubricant coating as a release coating that is capable of being cured within six hours at ambient temperature of between 60 and 100° F. and a relative humidity of at least 50 percent. This product is then usable in full or segmented bore holes of devices to provide the desired heat and which thereafter then is easily removable without flaking or chalking of the coating on the heater. Because the release coating is fully cured, it remains in place during insertion in a bore hole. This avoids damaging the device because the heater is easily removable.

It will be understood that modifications and variations may be effected without departing from the scope of the novel concepts of the present invention, but it is understood that this application is to be limited only by the scope of the appended claims.

What is claimed is:

1. A cartridge heater for mounting in a bore hole of a device to heat the device, said heater including an outer metal sheath capable of withstanding high temperatures, and completely cured release means on the sheath before use for facilitating removal of the heater from a bore hole subsequent to operation of the heater, wherein said release means remains substantially intact upon removal of the heater from said device, said release means comprising a cured coating of a fast-drying graphite-based solid film lubricant with an organo-metallic binder system in a solvent carrier, wherein said lubricant provides a low coefficient of friction on the sheath and thermal stability for operating in high temperature conditions.

2. The cartridge heater of claim 1, wherein the coating is in liquid form when applied to the outer sheath after the sheath has been prepared by being degreased, grit-blasted, and subjected to removal of any residual blast media, and wherein said coating after application to said sheath is quick drying and air dries to the touch in less than five minutes in an ambient of 60 to 100° F. and a relative humidity of at least fifty percent, and fully cures within six hours in said ambient.

3. The cartridge heater of claim 1, wherein said metal sheath is a steel alloy.

4. The cartridge heater of claim 1, wherein said metal sheath is a titanium alloy.

5. The cartridge heater of claim 1, wherein said metal sheath is a stainless steel.

6. The method of preparing and coating a cartridge heater having a steel alloy sheath for use in a bore hole of a device with a liquid solid film lubricant that is graphite based with an organo-metallic binder system in a solvent carrier to prevent the heater from seizing in the bore hole after use at elevated temperatures, said lubricant on said heater being dry to touch in a few minutes after application and cured in a few hours when in an ambient of 60 to 100° F. and a relative humidity of about 50 percent and capable of maintaining thermal stability to remain substantially intact after usage, said step of preparation including:

degreasing the sheath, grit-blasting the sheath, and cleaning the sheath to remove any residual blast media.

7. The method of claim 6, wherein the step of coating includes spraying the lubricant onto said sheath of the heater.

8. The method of claim 6, wherein the step of coating includes dipping the heater into a bath of lubricant and withdrawing the heater from the bath.

9. The method of claim 6, wherein the step of coating includes dipping the heater into a bath of lubricant and withdrawing the heater from the bath, and spinning the heater to remove excess lubricant.

10. The method of claim 6, wherein the step of curing includes placing the coated heater in an atmosphere of 60 to 100° F. and a relative humidity of at least 50 percent for about six hours.

11. The method of claim 6, wherein the lubricant coating dries to touch in a few minutes in an ambient of about 60 to 100° F. and a relative humidity of at least fifty percent, and fully cures within six hours in substantially the same ambient.

12. The method of claim 6, which method further includes passivating the sheath of the heater following said step of cleaning the sheath.

13. The combination of a cartridge heater mounted in a bore hole of a device for heating the device, wherein said cartridge heater includes an outer metal sheath, and a release coating on said metal sheath cured prior to mounting in said bore hole to facilitate removal of the cartridge from the bore hole following the operation of the cartridge at an elevated temperature, the improvement in the release coating which comprises a solid film lubricant that is air-curable at ambient temperature to touch within about five minutes, and substantially completely cured within about six hours after application thereof to the sheath in an ambient of 60 to 100° F. and a relative humidity of at least fifty percent, said lubricant being graphite based with an inorganic binder system in a solvent carrier.

14. The combination as in claim 13, wherein the sheath is a steel alloy that can withstand temperatures up to about 1600° F.

* * * * *